US010603922B2

(12) United States Patent
Otis et al.

(10) Patent No.: US 10,603,922 B2
(45) Date of Patent: Mar. 31, 2020

(54) VENT

(71) Applicant: HEWLETT-PACKARD DEVELOPMENT COMPANY, L.P., Houston, TX (US)

(72) Inventors: David R Otis, Corvallis, OR (US); Silam J Choy, Corvallis, OR (US); Kevin E Swier, Albany, OR (US); Zhuqing Zhang, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 4 days.

(21) Appl. No.: 15/542,024

(22) PCT Filed: Jan. 22, 2015

(86) PCT No.: PCT/US2015/012462

§ 371 (c)(1),
(2) Date: Jul. 6, 2017

(87) PCT Pub. No.: WO2016/118143

PCT Pub. Date: Jul. 28, 2016

(65) Prior Publication Data

US 2017/0368835 A1 Dec. 28, 2017

(51) Int. Cl.

| | |
|---|---|
| ***B41J 2/19*** | (2006.01) |
| ***B41J 2/175*** | (2006.01) |
| ***B41J 2/14*** | (2006.01) |

(52) U.S. Cl.

CPC ..... *B41J 2/19* (2013.01); *B41J 2/175* (2013.01); *B41J 2002/14483* (2013.01)

(58) Field of Classification Search

CPC .... B41J 2002/14483; B41J 2/175; B41J 2/19; B41J 2/17513; B41J 2/17563; B41J 2002/14403; B41J 2202/07; B41J 29/38

See application file for complete search history.

(56) References Cited

U.S. PATENT DOCUMENTS

| | | | |
|---|---|---|---|
| 5,546,109 | A | 8/1996 | Nakano |
| 6,338,554 | B1 | 1/2002 | Kitahara |
| 6,457,820 | B1 | 10/2002 | Cai |
| 6,520,633 | B2 | 2/2003 | Nakamura |
| 7,238,224 | B2 | 7/2007 | Kent |
| 7,584,903 | B2 | 9/2009 | Koerner et al. |
| 7,887,160 | B2 | 2/2011 | Silverbrook |
| 8,277,034 | B2 | 10/2012 | Murray et al. |

(Continued)

FOREIGN PATENT DOCUMENTS

| | | |
|---|---|---|
| CN | 101052458 | 10/2007 |
| CN | 101654016 | 2/2010 |

(Continued)

OTHER PUBLICATIONS

Bubble Removal From Ink Jet Inks and Coatings Using SuperPhobic Membrane Contractors. Feb. 16, 2005. www.liqui-cel.com.

*Primary Examiner* — Jannelle M Lebron
(74) *Attorney, Agent, or Firm* — HP Inc. Patent Department

(57) ABSTRACT

In one example, a vent includes multiple parts each having a different resistivity to passing a gas. The parts are arranged so that the gas may pass through all parts simultaneously as long as the parts remain permeable to the gas.

20 Claims, 3 Drawing Sheets

(56) References Cited

U.S. PATENT DOCUMENTS

| | | | |
|---|---|---|---|
| 2009/0122121 | A1 | 5/2009 | Kawasaki et al. |
| 2012/0274711 | A1 | 11/2012 | Murray |
| 2013/0233418 | A1 | 9/2013 | Aldrich et al. |
| 2013/0300801 | A1 | 11/2013 | Stephens et al. |
| 2014/0205815 | A1 | 7/2014 | Hodgins et al. |

FOREIGN PATENT DOCUMENTS

| | | | | |
|---|---|---|---|---|
| CN | 101654016 | A | * | 2/2010 |
| JP | 2003-049629 | | | 2/2003 |
| JP | 2003237102 | | | 8/2003 |
| JP | 2010-058323 | | | 3/2010 |
| WO | WO-2006055490 | | | 5/2006 |

* cited by examiner

VENT

BACKGROUND

Ait bubbles can interfere with the proper delivery of ink and other printing liquids to the dispensing nozzles in an inkjet printer. Air bubbles may enter the printing liquid delivery system from the outside, for example through dispensing nozzles and system connections, and by outgassing during large temperature and pressure changes. Inkjet printers, therefore, usually include some type of mechanism for removing air bubbles from the printing liquid delivery system.

DRAWINGS

The same part numbers designate the same or similar parts throughout the figures.

DESCRIPTION

In some inkjet printers, a vent membrane that passes air but not liquid is used to help remove air bubbles from ink or other printing liquids. Lower pressure on the dry side of the membrane draws air bubbles in the printing liquid from the wet side of the membrane to the dry side where the air can be warehoused or released to the atmosphere. The membrane materials used in long lasting print bars that are replaced infrequently (or not at all) must maintain good air permeability for long periods exposed to printing liquids. Suitable membrane materials typically have lower air permeability and thus lower venting rates compared to more permeable materials that can lose much of their permeability too soon after exposure to printing liquids. While lower permeability materials can provide adequate venting during normal printing operations, they slow the process of filling a print bar at start-up when air or shipping fluid is replaced with printing liquid.

A multi-part vent has been developed to enable faster venting during start-up while still maintaining good air permeability for long periods exposed to the printing fluid. In one example, the vent includes two membranes arranged parallel to one another for simultaneous venting through both membranes. One membrane has a higher air permeability (lower resistivity) and the other membrane has a lower air permeability (higher resistivity). A dual membrane vent provides a cost-effective solution to achieve greater venting capacity for faster filling at start-up without compromising long term performance in the event the lower resistivity membrane material fails (to vent) soon after exposure to the printing liquid.

The examples shown in the figures and described herein illustrate but do not limit the scope of the claimed subject matter, which is defined in the Claims following this Description. Examples are not limited to printing with ink but also include inkjet type dispensing of other liquids and/or for uses other than printing.

Figure 1:
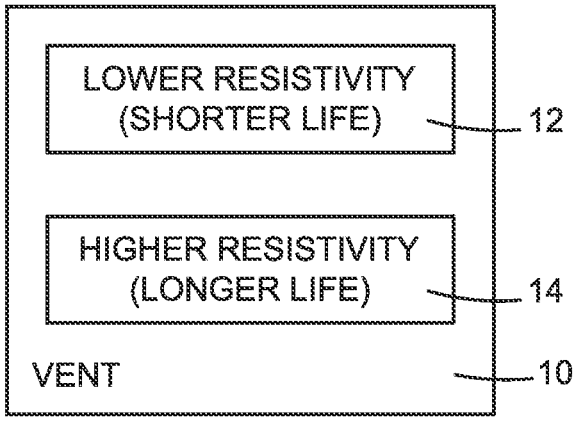
FIG. 1 is a block diagram illustrating one example of a multi-part vent.
Figure 2:
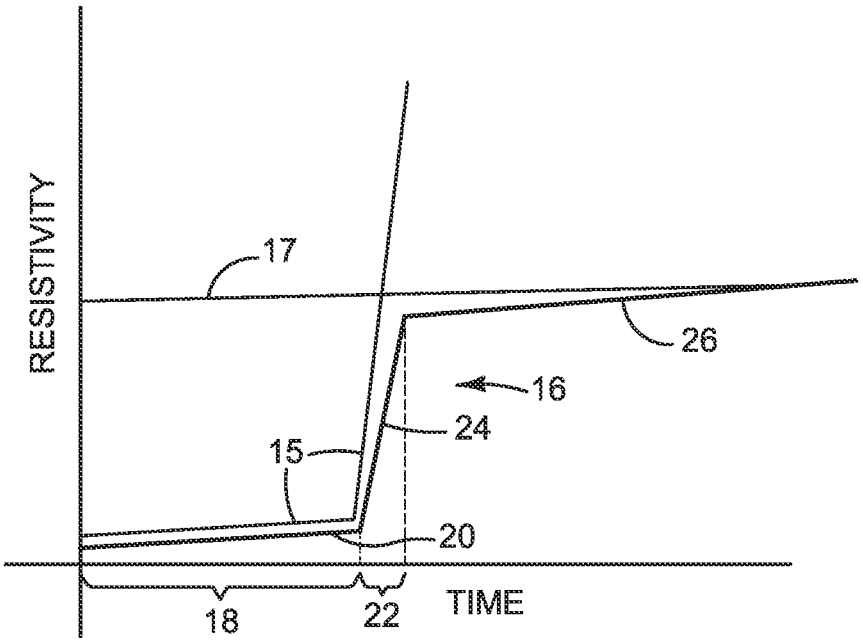
FIG. 2 is a graph illustrating one example for the functional characteristics of a vent such as the vent shown in FIG. 1.

FIG. 1 is a block diagram illustrating one example of a new, multi-part gas vent 10. FIG. 2 is a graph illustrating one example for the functional characteristics of a gas vent, such as vent 10 shown in FIG. 1. Referring first to FIG. 1, vent 10 includes a first, "lower" resistivity part 12 arranged in parallel with a "higher" resistivity part 14 so that air or another gas may vent simultaneously through both parts 12 and 14, so long as both parts remain permeable to the gas. "Lower" and "higher" in this context refers to the relative permeability of the two parts initially, when the parts are first exposed to ink or other liquid. As described below, the relative permeability of the parts can change after the initial exposure to liquid. Each part 12, 14 may be configured as a membrane that is permeable to the gas, air for example, and impermeable to a liquid, ink for example. In this configuration, vent 10 also functions as a gas-liquid separator.

Currently, the useful life of membrane materials suitable for use in venting air from ink in an inkjet printer varies depending on the resistivity of the material, which can change after exposure to ink. Testing indicates the performance of some membrane materials with initially lower air resistivity (higher air permeability) may degrade quickly after exposure to inks commonly used for inkjet printing while the performance of materials with initially higher air resistivity (lower air permeability) remains steady for long periods of ink exposure. Lower resistivity membrane materials often have a shorter useful life while higher resistivity materials have a longer useful life.

The graph of FIG. 2 illustrates one example of the functional characteristics of a multi-part vent 10 in which the first lower resistivity part 12 has a shorter useful life compared to the higher resistivity part 14. Referring to FIG. 2, line 16 represents the total resistivity of vent 10 over time, for example throughout the duration of exposure to ink for vent parts 12, 14 in FIG. 1 implemented as air-ink separating membranes. Line 16 represents the combined resistivity of a first membrane 12, represented by line 15, and vent membrane 14, represented by line 17. During an initial period 18, the resistivity of vent 10 increases gradually at a steady rate, indicated by line segment 20, as both membranes 12 and 14 pass gas effectively. During a transition period 22, the resistivity of vent 10 increases sharply, indicated by line segment 24, as the performance of lower resistivity membrane 12 degrades rapidly until the vent resistivity assumes a value corresponding to that of the longer life membrane throughout the remainder of the useful life of vent 10, as indicated by line segment 26.

Figure 3:
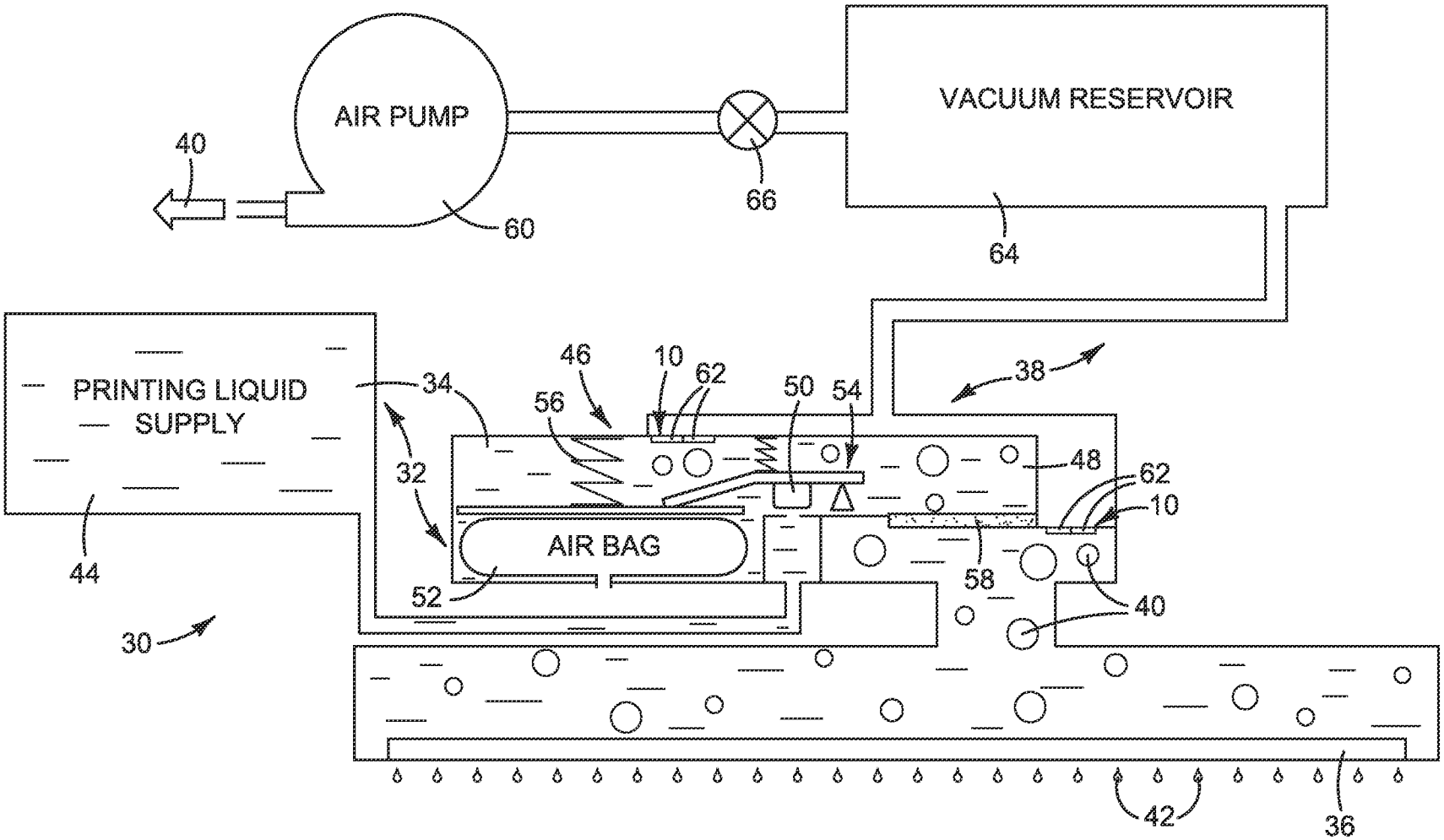
FIG. 3 illustrates an inkjet printer implementing one example of a multi-part vent.
Figure 4:
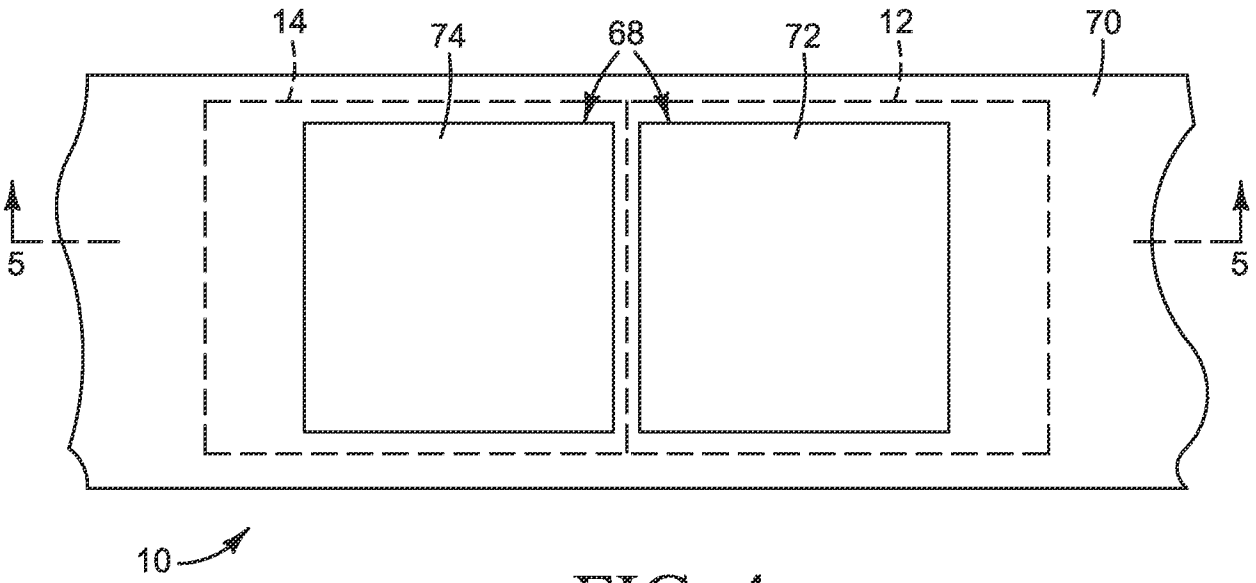
FIGS. 4 and 5 illustrate one example of a multi-part liquid-air separating membrane such as might be used in the air vent shown in FIG. 1.
Figure 5:
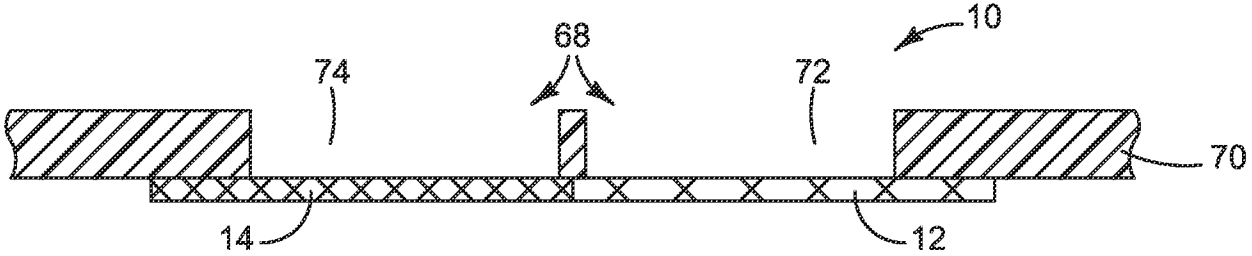

FIG. 3 illustrates an inkjet printer 30 implementing a multi-part air vent 10. FIGS. 4 and 5 show one example of a vent 10 in printer 30 in detail. Referring first to FIG. 3, printer 30 includes a liquid delivery system 32 to carry ink or other printing liquid 34 to one or multiple printheads 36, and an air management system 38 to remove air bubbles 40 from printing liquid 34. (As used in this document, "liquid" means a fluid not composed primarily of a gas or gases.) Printhead 36 represents generally that part of printer 30 for dispensing liquid from one or more openings, for example as drops 42, including what is also sometimes referred to as a printhead die, a printhead assembly and/or a print bar. Printer 30 and printhead 36 are not limited to printing with ink but also include inkjet type dispensing of other liquids and/or for uses other than printing.

Liquid delivery system 32 includes a supply 44 of printing liquid 34 and a flow regulator 46 to regulate the flow of liquid 34 from supply 44 to printhead 36. In the example shown, the flow of liquid 34 into regulator chamber 48 is controlled by a valve 50. An air bag 52 expands and contracts to close and open valve 50 through a linkage 54. Bag 52 is open to the atmosphere or connected to another suitable source of air pressure. A biasing spring 56 exerts a predetermined force on bag 52 to maintain the desired pressure in chamber 48, which is usually a slightly negative pressure (gage) to help prevent liquid drooling from printhead 36 when the printer is idle. A filter 58 is commonly used to remove impurities.

Air management system 38 includes vents 10 from liquid chamber 48 and an air pump 60 operatively connected to each vent 10. Pump 60 evacuates air from the dry side of each vent 10 to lower the pressure to allow air bubbles 40 in printing liquid 34 to pass through a vent membrane 62. Membrane 62 allows air bubbles 40 to pass to the dry side but blocks liquid 34, at least within the normal operating conditions for delivery system 32.

In the example shown, each vent 10 is connected to pump 60 through a vacuum reservoir 64 maintained at a desired range of lower pressures. As air bubbles 40 move through vents 10, the pressure in reservoir 64 will rise (i.e., the degree of vacuum declines) so that the vacuum must be periodically refreshed by opening a control valve 66 and running pump 60. Also in the example shown, two air vents 10 are used to remove air from liquid chamber 48. One vent 10 is upstream from filter 58 (in the direction of liquid flow through chamber 48) and another vent 10 is downstream from filter 58.

FIGS. 4 and 5 show one example a vent 10 in more detail. Referring to FIGS. 4 and 5, vent 10 includes an opening 68 in chamber housing 70 and a membrane 62 covering opening 68. In the example shown, membrane 62 includes a first lower air resistivity (higher air permeability) part 12 covering a corresponding first part 72 of opening 68 and a second higher air resistivity (lower air permeability) part 14 covering a corresponding second part 74 of opening 68. Parts 12 and 14 are arranged parallel to one another so that air may vent simultaneously through both parts 12 and 14.

Suitable lower resistivity, higher air permeability vent materials include GORE® D10 SFO ePTFE with a characteristic pore dimension of approximately 2 microns and NITTO DENKO Temish® S-NTF2122A-S06, an ePTFE material with an oleophobic treatment on a non-woven PET carrier. Suitable higher resistivity, lower permeability venting materials include PALL® Infuzor brand membrane materials with a thinner (e.g., 1-2 micron) layer of non-porous PTFE over a thicker (e.g., 25 micron) layer of ePTFE. Other suitable vent materials are possible. For example, it is expected that some of the PTFE and other "breathable" fabrics currently available may be modified to provide the desired functional characteristics for each vent part 12, 14.

In one example for an inkjet printer such as printer 10 shown in FIG. 1 implementing a page wide print bar 36, each vent 10 may be expected to vent air at a rate of at least 10 cc/minute to fill the print bar with ink and then at a rate of at least 0.5 cc/week throughout the life of the print bar, at a pressure difference across the vent in the range of 12 to 80 in$H_2O$. While the actual venting capacity and the size of each vent to deliver the desired capacity will vary depending on the particular implementation, it is expected that a total resistivity less than 0.35 in$H_2O$/(cm/min) to fill the print bar and a total resistivity less than 150,000 in$H_2O$/(cm/min) throughout the useful life of the vent can provide adequate venting.

Other configurations/arrangements vent parts 12, 14 are possible. For one example, more than two vent parts may be used and/or with varying characteristics both for flow rate and longevity. For another example, other shapes for vent parts 12, 14 are possible including disks and rings.

"A" and "an" used in the claims means one or more.

The examples shown in the figures and described above illustrate but do not limit the scope of the patent, which is defined in the following Claims.

What is claimed is:

1. A vent, comprising multiple parts each having a different resistivity to passing a gas, the parts arranged so that the gas may pass through all parts simultaneously as long as the parts remain permeable to the gas.

2. The vent of claim 1, where each part is to pass a gas but not a liquid.

3. The vent of claim 2, where the parts together are to pass gas at a first rate for a first duration after the vent is first exposed to the liquid and then at a second rate lower than the first rate for a second duration longer than the first duration.

4. The vent of claim 3, where the gas is air and the liquid is ink.

5. The vent of claim 4, where the gas resistivity of one of the multiple parts increases faster than another of the multiple parts.

6. The vent of claim 1, wherein the parts are arranged in parallel such that the gas may pass through all parts in parallel as long as the parts remain permeable to the gas.

7. The vent of claim 1, wherein the multiple parts comprise:

a first part having a first face facing in a first direction and in contact with a volume containing the gas and liquid, the first part having a first resistivity to passing the gas; and a second part having a second face facing in the first direction and in contact with the volume of the gas containing the gas and the liquid, the second part having a second resistivity to passing the gas different than the first resistivity.

8. The vent of claim 1, wherein the multiple parts comprise:

a first part having a first resistivity to passing of the gas; and a second part having a second resistivity to passing of the gas, the first part and the second part being coplanar.

9. A vent to:

pass a gas but not a liquid at a pressure difference across the vent;

pass the gas at the pressure difference at a first rate for a first duration after the vent is first exposed to the liquid; and then, after the first duration, pass the gas at the pressure difference at a second rate slower than the first rate.

10. The vent of claim 9, including an initially lower resistivity part and an initially higher resistivity part arranged with respect to one another so that the gas may vent simultaneously through both parts at least throughout the first duration.

11. The vent of claim 10, where each part comprises a distinct membrane arranged with respect to one another so that the gas may pass simultaneously through both membranes at least throughout the first duration.

12. The vent of claim 10, where the initially lower resistivity part has the first gas resistivity for a first duration and the initially higher resistivity part has the second gas resistivity for a second duration longer than the first duration.

13. The vent of claim 10, wherein the initially lower resistivity part and the initially higher resistivity part are arranged in parallel so that the gas may vent simultaneously through the initially lower resistivity part in the initially higher resistivity part in parallel at least during the first duration.

14. A system, comprising:

a chamber to hold a printing liquid;

a reservoir to hold air; and a vent through which air but not liquid may pass from the chamber to the reservoir within a range of pressure differences across the vent, the vent including:

a first membrane having a first air resistivity for a first duration; and a second membrane arranged to pass air simultaneously with the first membrane, the second membrane having a second air resistivity greater than the first air resistivity for the first duration.

15. The system of claim 14, where the pressure difference is in the range of 12 to 80in$H_2O$.

16. The system of claim 15, where the membranes together are to pass air at a first rate for a first duration after the vent is first exposed to the liquid and then at a second rate lower than the first rate for a second duration longer than the first duration.

17. The system of claim 16, where the air resistivity of the first membrane increases faster than the air resistivity of the second membrane.

18. The system of claim 14, wherein the vent is to pass a total volume of the air from the chamber during a period of time, the total volume being no less than a sum of a first volume of the air that is passed from the chamber through the first membrane and a second volume of the air that is passed from the chamber through the second membrane.

19. The system of claim 14, wherein the first membrane is to pass a first volume of the air from the chamber at a first rate and wherein the second membrane is to pass a second volume of the air from the chamber, at a second rate different than the first rate and concurrent with the passing of the first volume of the air by the first membrane.

20. The system of claim 14, wherein first membrane and the second membrane are arranged such that a volume of the gas may pass through either of the first membrane or the second membrane without having passed through the other of the first membrane or the second membrane.

* * * * *